US006367659B1

(12) United States Patent
Seidler

(10) Patent No.: US 6,367,659 B1
(45) Date of Patent: Apr. 9, 2002

(54) TELESCOPIC LIQUID DISPENSER

(75) Inventor: David Seidler, Forest Hills, NY (US)

(73) Assignee: Concept Workshop Worldwide LLC, New York, NY (US)

( * ) Notice: Subject to any disclaimer, the term of this patent is extended or adjusted under 35 U.S.C. 154(b) by 0 days.

(21) Appl. No.: 09/645,170

(22) Filed: Aug. 24, 2000

(51) Int. Cl.[7] ..... B67D 5/00
(52) U.S. Cl. ..... 222/83; 222/153.13; 222/209
(58) Field of Search ..... 222/153.13, 83, 222/209, 211, 215; 604/216

(56) References Cited

U.S. PATENT DOCUMENTS

| | | | | |
|---|---|---|---|---|
| 2,738,107 A | | 3/1956 | Graham | |
| 3,340,869 A | | 9/1967 | Bane | |
| 3,712,295 A | | 1/1973 | Kline | |
| 4,098,434 A | * | 7/1978 | Uhlig | 222/209 |
| 4,296,071 A | | 10/1981 | Weiss et al. | |
| 4,349,129 A | | 9/1982 | Amneus | |
| 4,411,656 A | | 10/1983 | Cornett, III | |
| 5,242,422 A | | 9/1993 | Schneberger et al. | |
| 5,306,125 A | * | 4/1994 | Weag | 222/83 |
| 5,328,060 A | * | 7/1994 | Kersten et al. | 222/209 |
| 5,462,208 A | * | 10/1995 | Stahey et al. | 222/209 |
| 5,538,506 A | | 7/1996 | Farris et al. | |
| 5,613,957 A | | 3/1997 | Py | |
| 5,638,986 A | | 6/1997 | Tuominen et al. | |
| 5,683,369 A | | 11/1997 | Tsukada | |
| 5,950,690 A | | 9/1999 | Seidler | |
| 6,045,003 A | | 4/2000 | Seidler | |

* cited by examiner

*Primary Examiner*—Philippe Derakshani
(74) *Attorney, Agent, or Firm*—Amster, Rothstein & Ebenstein

(57) ABSTRACT

A dispenser for dispensing a preselected amount of liquid includes a base; at least one bellows at least partially disposed in the base and configured and dimensioned to hold a first preselected amount of liquid, and a manually actuable actuator in telescopic relationship with the base for compressing the bellows therebetween and discharging a second preselected amount of liquid from the bellows.

24 Claims, 10 Drawing Sheets

FIG. 1A
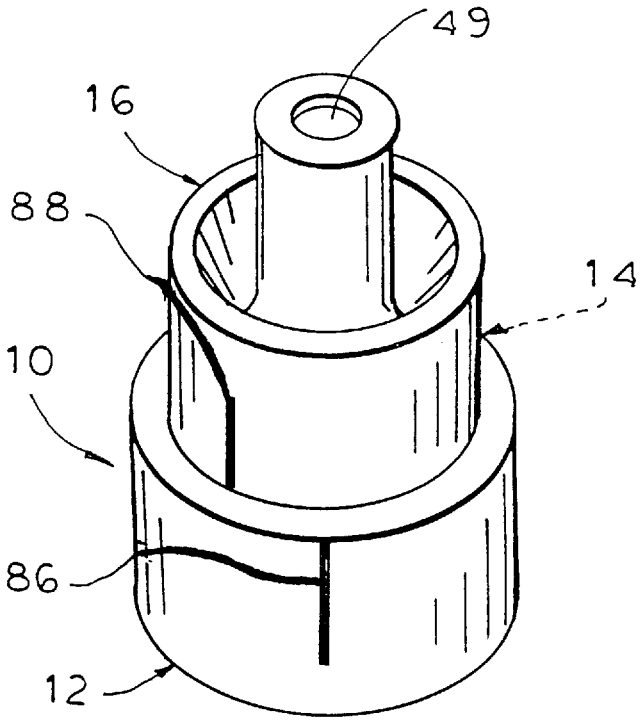
FIG. 2A
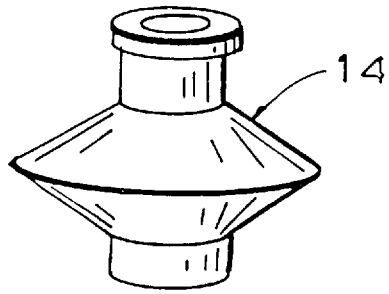
FIG. 1B
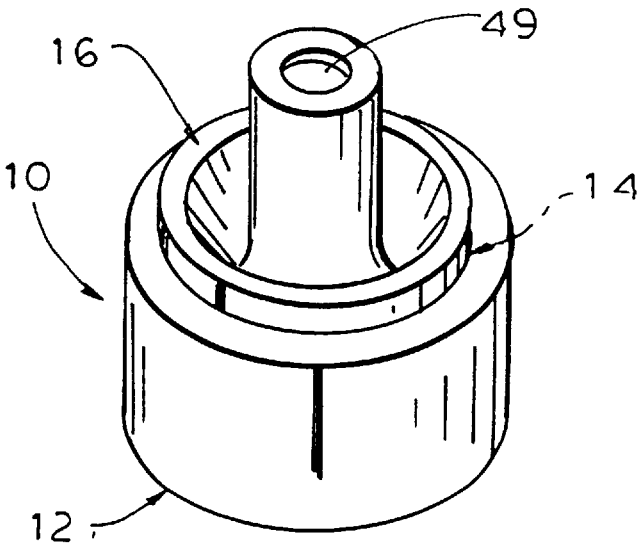
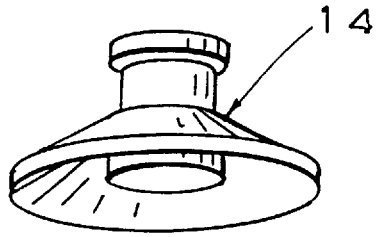
FIG. 2B 10
12
14
16
20
22
24
28
28A
30
32
40
42
44
46
48
49
50
60
62
70
78

TELESCOPIC LIQUID DISPENSER

BACKGROUND OF THE INVENTION

The present invention relates generally to a liquid dispenser, and more particularly to apparatus for dispensing a preselected amount of liquid from bellows.

While apparatus for dispensing a liquid are well known in the dispenser art, relatively few store the liquid (prior to dispensing) in a bellows. Various reasons may be postulated for this. First, a bellows configuration is difficult to grasp and hold, let alone manually compress axially to collapse the bellows. Second, the amount of liquid discharged from the bellows varies with the degree of axial compression of the opposed bellows ends so that a uniform expression or expulsion of liquid is not easily obtainable. For these and other reasons, the use of bellows in a liquid dispenser is not common. Therefore, the need remains for a liquid dispenser which stores the liquid (prior to dispensing) in a bellows and overcomes the various disadvantages associated with conventional bellows-type dispensers.

Accordingly, it is an object of the present invention to provide apparatus for dispensing a preselected amount or dosage of liquid where the liquid is stored in at least one bellows.

Another object is to provide such apparatus which in one embodiment dispenses in turn multiple dosages of liquid.

A further object is to provide such apparatus which in one embodiment dispenses a generally reproducible preselected amount or dosage of liquid.

It is another object to provide such an apparatus which is simple and economical to manufacture, use and maintain.

SUMMARY OF THE INVENTION

It has now been found that the above and related objects of the present invention are obtained in apparatus for dispensing a preselected amount of liquid comprising a base; at least one bellows at least partially disposed in the base, and a manually actuatable actuator in telescopic relationship with the base for compressing the bellows therebetween. The bellows is configured and dimensioned to hold a first preselected amount of liquid, and the actuator discharges a second preselected amount of liquid from the bellows.

In a preferred embodiment, the bellows is initially provided with a seal to preclude release of liquid therefrom, and the actuator includes means for rupturing the seal to enable liquid discharge from the bellows. After rupture of the seal, all portions of the seal preferably remain secured to the bellows. The rupturing means typically effects a piercing action on the seal.

The actuator may define a cup-shaped portion configured and dimensioned to receive and maintain liquid dispensed from the bellows and optionally a hollow center post portion having one end in fluid communication with the bellows after rupture of the seal and an opposite end projecting upwardly from the cup-shaped portion.

In another preferred embodiment, the at least one bellows is a plurality of integrally joined bellows in fluid communication with one another and at least partially disposed in the base. The actuator is capable of sequentially assuming multiple orientations relative to the base, thereby to sequentially dispense multiple doses of liquid form the bellows. The multiple orientations are multiple differing telescopic orientations. The base and the actuator preferably bear visible indicia indicating the relative rotational orientation of the base and the actuator.

In a further embodiment, the base is in non-rotational sliding telescopic engagement with the actuator due to an internal key and keyway assembly such that axial movement of the actuator relative to the base in a given direction effects at least partial collapse of the bellows. The base and the actuator preferably bear visible indicia indicating the relative orientation of the key and keyway.

The bellows is preferably disposed intermediate a lower-facing surface of the actuator and an upper-facing surface of the base. The first and second preselected amounts of liquid are preferably substantially the same, although they may be appreciably different.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIGS. 1A and 1B are isometric views of a liquid dispenser according to a first embodiment of the present invention in a pre-use orientation and a post-use orientation, respectively;

FIGS. 2A and 2B are isometric views of a bellows in a pre-use (full) orientation and a post-use (empty) orientation, respectively;

DETAILED DESCRIPTION OF THE PREFERRED EMBODIMENTS

Figures 3A, 3B:
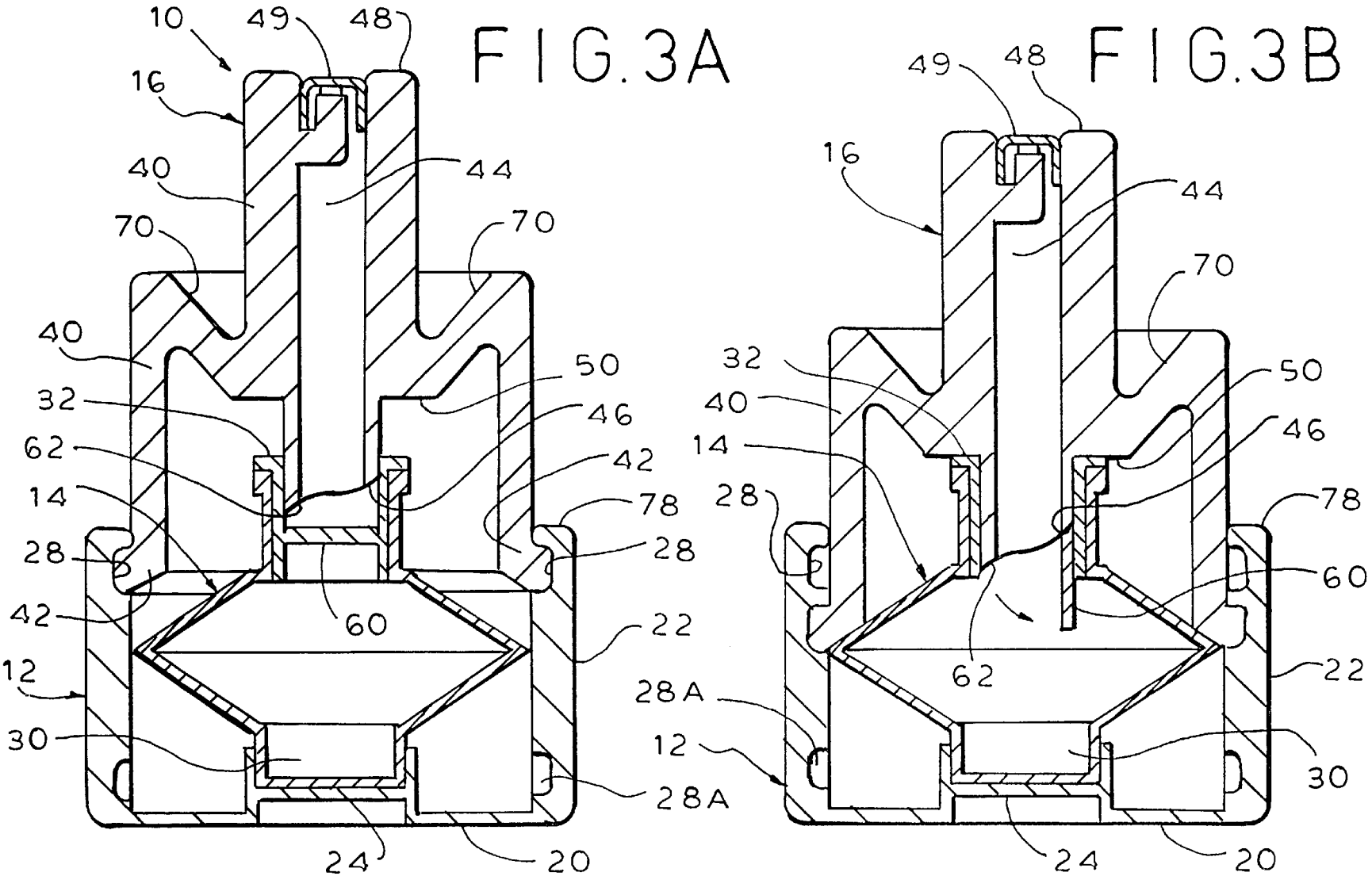
FIGS. 3A, 3B and 3C are sectional views of the dispenser in a pre-use (expanded) orientation, a use (partially collapsed) orientation, and a post-use (collapsed) orientation, respectively.

Referring now to the drawing, and in particular to FIGS. 1A and 1B thereof, therein illustrated is an apparatus according to the present invention, generally designated 10. Generally, the apparatus 10 is configured and dimensioned to dispense a preselected amount of liquid. The apparatus 10 comprises a base generally designated 12, at least one bellows at least partially disposed in the base 12 and generally designated 14, and a manually actuable actuator 16 in telescopic relationship with the base 12 for compressing the bellows 14 therebetween. As illustrated in FIGS. 2A and 2B, the bellows 14 is configured and dimensioned to hold a first preselected amount of liquid, and the base 12 and actuator 16 are configured and dimensioned to discharge a second preselected amount of liquid from the bellows 14 by axially collapsing the bellows between an upper-facing surface of the base 12 and a lower-facing surface of the actuator 16.

As illustrated, the base 12 and actuator 16 are of substantially cylindrical configuration (albeit with a step inward in the actuator), while the base 12, actuator 16 and bellows 14 are coaxially disposed about a central longitudinal axis of the apparatus 10.

Assuming that the bellows 14 is configured and dimensioned to hold only a single-unit dosage of liquid and expel the same upon full axial compression of the base 12 and actuator 16, the initially charged bellows is in an expanded (full) configuration, as illustrated in FIG. 2A, but, after the full telescopic action of the base and actuator (by axial compression of the base 12 and the actuator 16), the bellows 14 is substantially devoid of liquid and exhibits the collapsed (empty) bellows configuration, as illustrated in FIG. 2B.

Figure 3C:
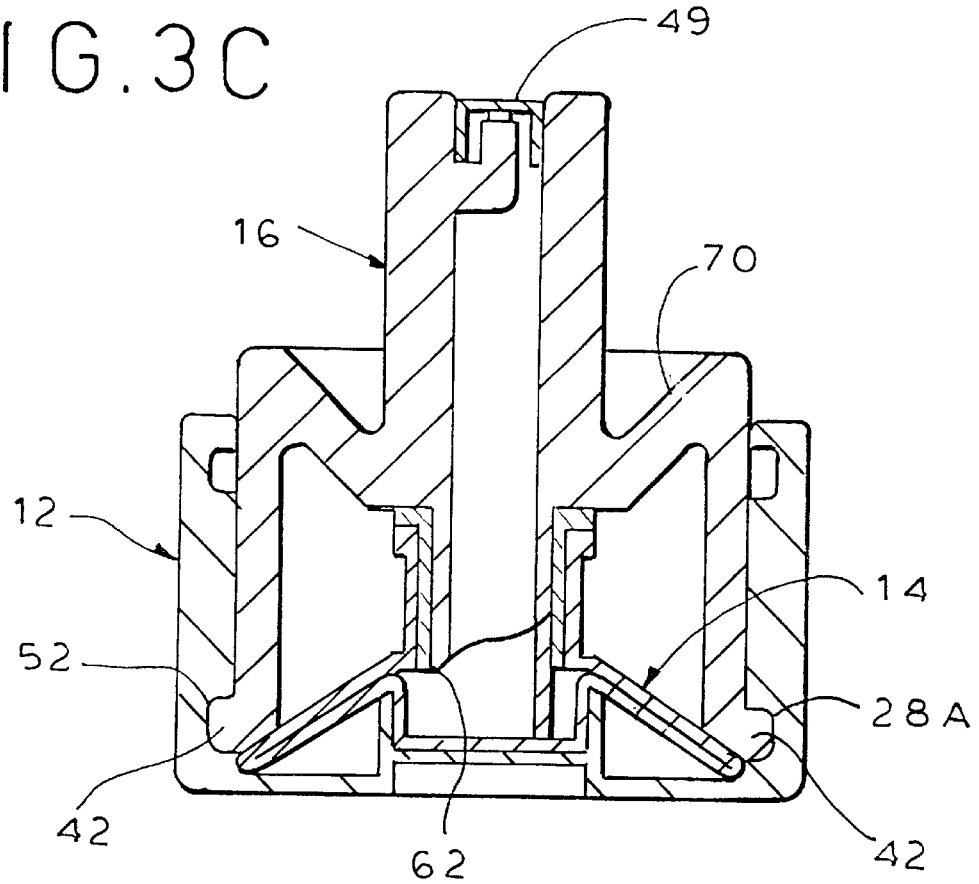

Referring now to FIGS. 3A, 3B and 3C, therein illustrated is the apparatus 10 according to a first embodiment of the present invention, useful for a single-unit dosage only. The apparatus is illustrated prior to use (FIG. 3A), during use (FIG. 3B), and after use (FIG. 3C).

The base 12 is generally cup-shaped with a generally planar floor or bottom wall 20 and a sidewall 22 upstanding therefrom. The bottom wall 20 preferably defines means 24 for centrally receiving a bottom end 30 of the bellows 14. One end 30 (i.e., the bottom end) of the bellows may simply rest in the receiving means 24 or it may be secured thereto for movement therewith. The axially opposed end 32 (i.e., the top end) of bellows 14 is configured and dimensioned to receive a central portion of the actuator 16, as will be described hereinafter. The base 12 is preferably formed of a rigid material, such as a rigid plastic, so that there is little, if any, outward deflection of the base sidewall 22 during normal use.

The actuator 16 defines a central hollow post 44 having a bottom end 46 within the bellows top end 32 and a top end 48 configured and dimensioned to provide a spray for liquid traveling up the hollow or bore of central post 44. The actuator 16 preferably forms at its top end a cup-shaped portion configured and dimensioned to receive and maintain the liquid dispensed from the bellows 14 via the hollow center post 44. At top end 48 of post 44 is a conventional spray mechanism 49 (of types well known in the dispensing art) for obtaining a spray from liquid exiting the top of central hollow post 44.

In a preferred embodiment illustrated in FIG. 3A, adjacent the top of the base 12, the inner surface of the upstanding sidewall 22 defines a plurality of grooves 28. Adjacent the bottom of actuator 16, a sidewall 40 terminates in a downwardly and outwardly inclined flange 42 adapted to be received and maintained within the base grooves 28 to preclude accidental axial movement together (i.e., axial compression) of the base 12 and the actuator 16. Thus, in the absence of squeezing together of opposed sides of the actuator sidewall 40, the flanges 42 are initially received in the base grooves 28 to immobilize the assembly 10 against accidental actuation. The illustrated flange-groove design requires some flexibility of the actuator 16 adjacent its bottom (and more particularly, adjacent the flange 42 thereof). Clearly other designs may be utilized to the same end. As will be evident to those skilled in the dispenser art, in an alternative embodiment the grooves 28 may be disposed on an inner surface of the actuator sidewall adjacent the bottom thereof, and the flange 42 may extend outwardly from a resiliently flexible base sidewall.

Referring now in particular to FIG. 3B, after the actuator sidewall 40 has been squeezed together (adjacent the bottom thereof) to cause the withdrawal of the flanges 42 from the grooves 28, the actuator 16 and the base 12 are telescopically pressed together, thereby axially compressing the bellows 14 therebetween.

Referring now to FIG. 3C in particular, when the base 12 and actuator 16 have undergone the compressive limit of telescopic action, the bellows 14 is completely axially compressed. This axial compression of the bellows 14 is achieved both by the flanges 42 of the actuator 16 pressing downwardly on the outer rim of the top surface of the bellows 14 and by a more central bearing portion 50 of the actuator 16 pressing downwardly on the top end 32 of the bellows 14.

If desired, as illustrated in FIG. 3C, the base sidewall 22 may define adjacent the bottom thereof an outwardly extending groove 28A adapted to receive and maintain therein the flange 42 of the actuator as the resilient actuator sidewall 40 bears outwardly against the base sidewall 22 in the compressed orientation. This not only maintains the apparatus 10 in a compact orientation after use, but renders difficult, if not impossible, an undesirable refilling of the bellows 14 with liquid.

Referring once again to FIG. 3A, the bellows 14 is initially provided adjacent the top thereof with a seal 60 to preclude the premature release of liquid therefrom. The actuator 16 includes means 62 for rupturing or piercing the seal 60, thereby to enable liquid discharge from the bellows 14. More particularly, the rupturing means 62 is a downward projection of the bottom end 46 of center hollow post 44, which projection does not extend entirely about the circumference of the post 40. Referring now to FIG. 3B, thus, after rupture of the seal 60 by rupturing means 62, all portions of the seal 60 remain secured to the bellows 14 so that such portions are not subsequently accidentally ejected from the apparatus 10 or allowed to interfere with collapse of the bellows 14. Referring now to FIG. 3C, to this end, the length of the seal 60 is selected such that, when it depends within the bellows 14, it does not preclude emptying of the bellows 14. Preferably the rupturing means 62 simply effects a piercing action on the seal 60 so as to enable passage of liquid therethrough. It will be appreciated that, once the seal 60 has been ruptured, the hollow center post 44 and its end 46 (and hence its opposed end 48) are in fluid communication with the liquid contents of bellows 14.

Returning now to FIGS. 3A–3C, above or as part of the upper groove 28 in the base sidewall 22, an inwardly extending lip 78 may be provided to prevent accidental or intentional removal of the actuator 16 from the base 12. The lip 78 is configured and dimensioned to extend inwardly (toward the central axis of the apparatus) and over an upper surface of the actuator 16 so as to preclude an untelescoping action of the base and actuator such that they become separated either accidentally or intentionally. The extent to which the lip 78 will extend inwardly will depend upon the maximum compressibility of the actuator sidewall 40, the goal being that the lip 78 will act as a stop to preclude total untelescoping action even when the actuator flanges 42 are withdrawn from the base grooves 28 by manual transverse compression of the actuator sidewall 40.

While the actuator 16 is illustrated in FIGS. 1–3 as defining a relatively shallow cup-shaped portion configured and dimensioned to receive and maintain liquid dispensed from the bellows 14 through the hollow central post 44 in connection with a spray unit 49, for non-spray action the cup-shaped portion is preferably deeper and, indeed, may even extend above the top of the hollow central post 44.

The bellows 14 (and in particular the lower end 30 and the upper end 32 thereof) are trapped between the remaining parts of the apparatus 10, and more particularly between an upper-facing surface of the base 12 (and in particular the raised portion 24 of the bottom wall 20 thereof) and a lower-facing surface of the actuator 16 (and in particular the bottom end 46 of the central post 40 and the bearing surface 50). The major longitudinal axis of the bellows 14 is preferably parallel to the base and actuator sidewalls 22, 40, while the minor transverse axis is preferably perpendicular to the sidewalls 22, 40.

Bellows of the general type illustrated and described are well known in the art and may be formed of diverse materials in various configurations and dimensions. The movement of the bellows from its expanded (full) state to its collapsed (empty) state is achieved by the telescopic action of the base 12 and actuator 16, without regard to whether it is the base 12 which is moved upwardly or the actuator 16 which is moved downwardly. Indeed, in particular applications, the apparatus 10 may be used in an inverted position wherein the base 12 is higher than the actuator 16.

While the bellows 14 may be completely filled (that is, expanded to maximum capacity) by the presence of a first preselected amount of liquid therein, the second preselected amount of liquid expressed or discharged from the bellows, upon even complete collapse of the bellows, may be appreciably less than the full former contents of the bellows (i.e., less than the first preselected amount). In other words, while the first preselected amount of liquid contained by the bellows 14 in its expanded state is substantially the same as the second preselected amount of liquid expressed or discharged from the bellows, there may be an appreciable difference therebetween. This is because an appreciable amount of the liquid may be left as a very thin coating on the inner surface of the bellows 14 and even as a very thin coating on the inner surface of the bore of actuator post 44. The amounts of liquid left as a coating may cause the first and second preselected amounts of liquid to be appreciably different. While liquid dispensers used in medical situations (e.g., drug dispensers) may require that at least 99% of the preselected amount of liquid drug introduced into a liquid reservoir eventually be discharged into a patient, the present invention is primarily directed to use in environments wherein a substantially reproductible discharge or expression of the liquid in an amount equal to at least 90% by weight or volume of the preselected amount is acceptable (and, in some instances, even amounts as low as 80%).

Figure 4:
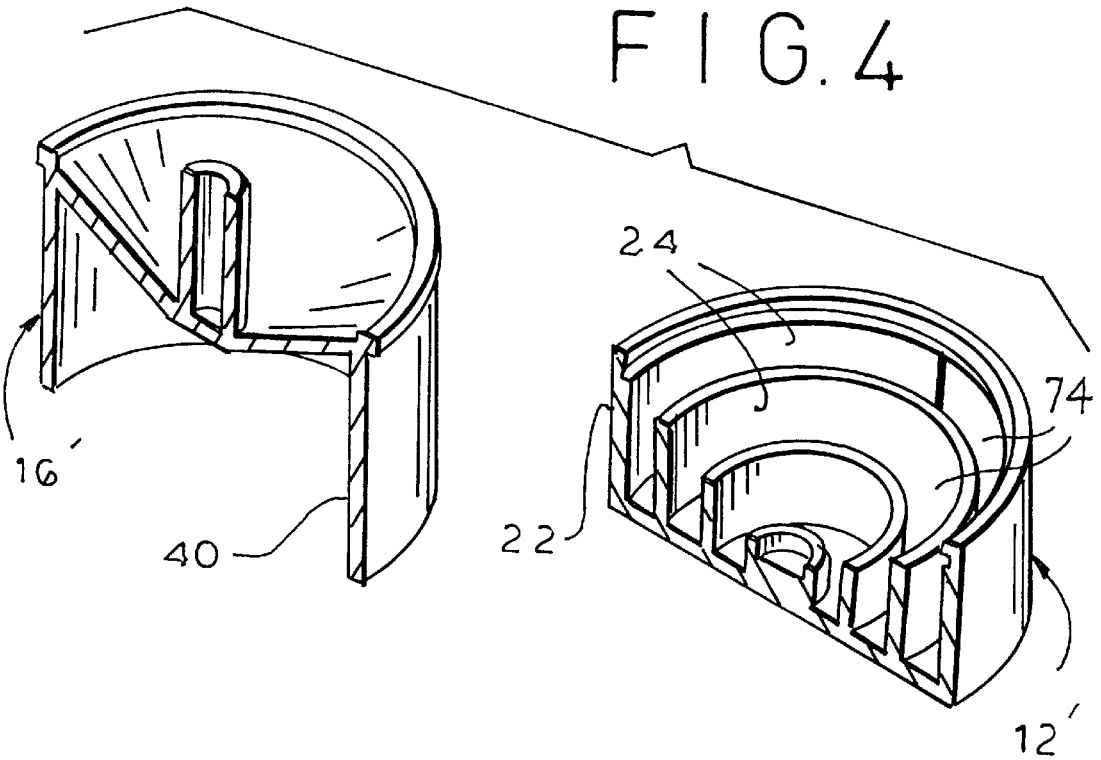
FIG. 4 is an exploded sectional view of the base and actuator of a variant of the first embodiment.

Referring now to FIG. 4, therein illustrated is a variant 10' of the present invention wherein the bellows 14 undergoes compression in the opposite direction. Thus, instead of the actuator 16 compressing the outer and inner portions of the bellows top end 22 downwardly (via the flanges 42 and An the central post end 46), the base 12' has interiorly of its sidewall 22 a plurality of upstanding elements 74. The elements 74 are illustrated as concentric rings, with the inner ring being short and the successive rings increasing in height to the outer ring (adjacent the sidewall 22). Similarly, the actuator 16' has its sidewall 40 (optionally bearing the flanges 28) shorter so that it does not bear on the outer surface of the bellows 14 and indeed permits upward movement of the outer surfaces of the bellows 14. Finally, the bellows 14 is constructed with either a shorter top end 32 (so that it does not bear against the bearing surfaces 50 of the actuator 16) or recesses are provided (to enable easy passage of the bellows upper end 32 thereinto). In this embodiment, instead of the bellows 14 collapsing downwardly to form an upright pyramid, the bellows 14 collapses upwardly to form an inverted pyramid.

Referring now to FIGS. 5A–7C, the inner surface of base 12 and the outer surface of actuator 16 preferably define together at least one keyway 80 and at least one key 82. In its extended or pre-use orientation, the actuator 16 is rotatable relative to the base 12 (for example, with the actuator flanges 42 in base grooves 28). Immediately below the groove 28, however, as illustrated, the inner surface of the base sidewall 22 defines a plurality of keyways 80 and the outer surface of the actuator sidewall 40 define a plurality of keys 82. Thus, in order to enable further telescopic action between the base 12 and actuator 16, the base 12 and actuator 16 must be rotated relative to one another until the keys 82 projecting outwardly from the actuator become vertically aligned with the keyways 80 extending outwardly from the inner surface of the base 12. The inner keyways preferably extend vertically to the bottom wall 20 of the base 12.

Figure 5A:
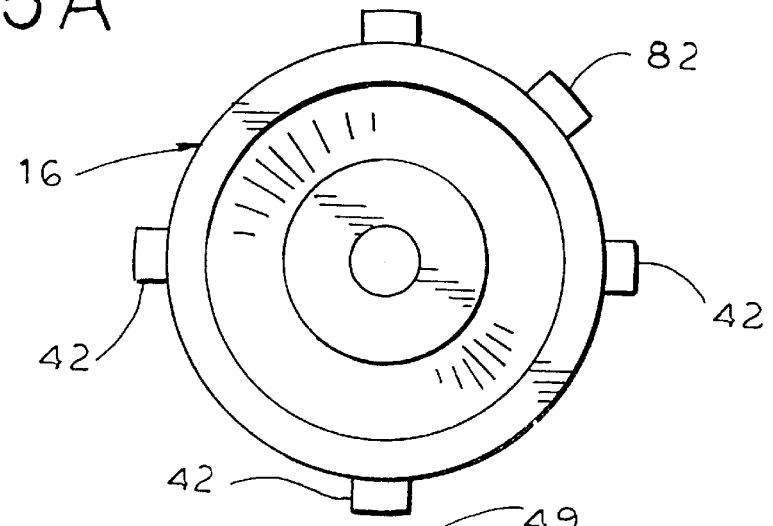
FIGS. 5A, 5B and 5C are top plan, sectional and bottom plan views, respectively, of the actuator.
Figure 5B:
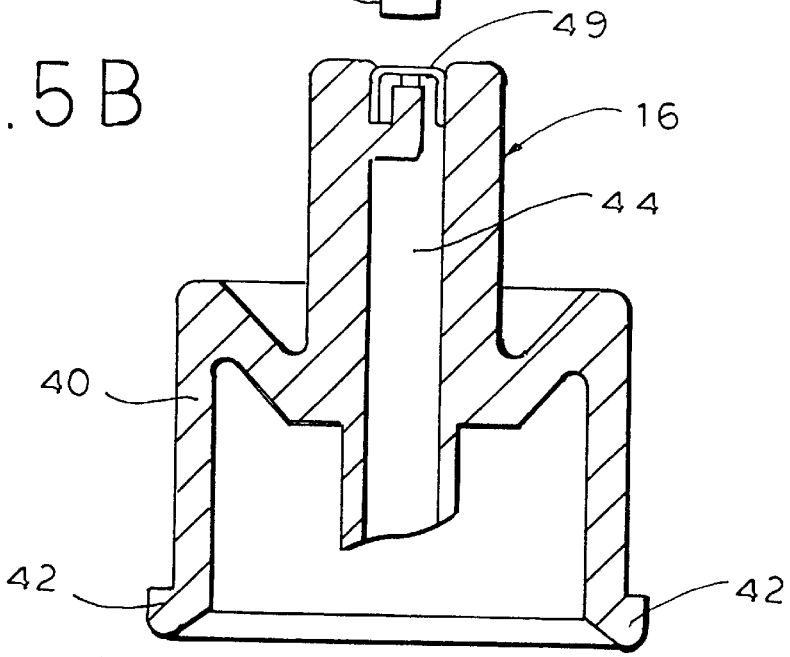
Figure 5C:
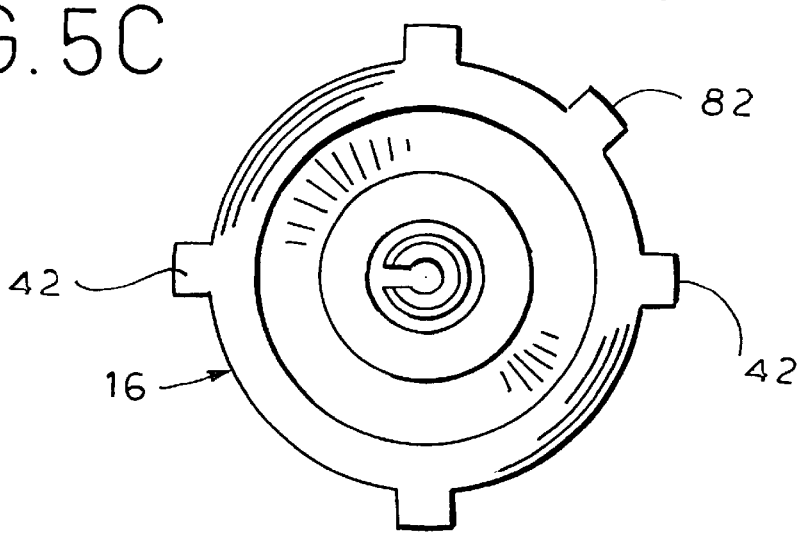
Figure 6A:
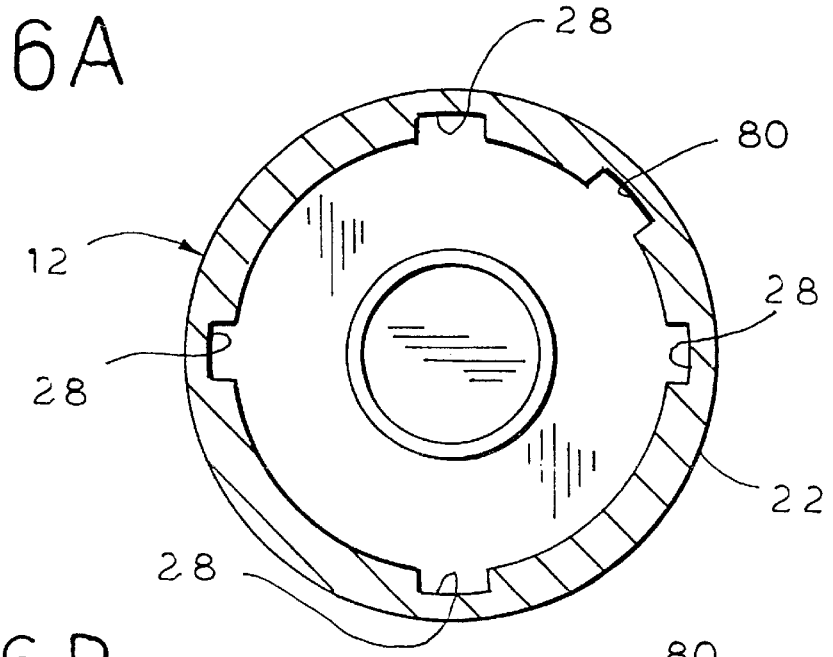
FIGS. 6A, 6B and 6C are top sectional, longitudinal sectional and bottom plan views, respectively, of the base.
Figure 6B:
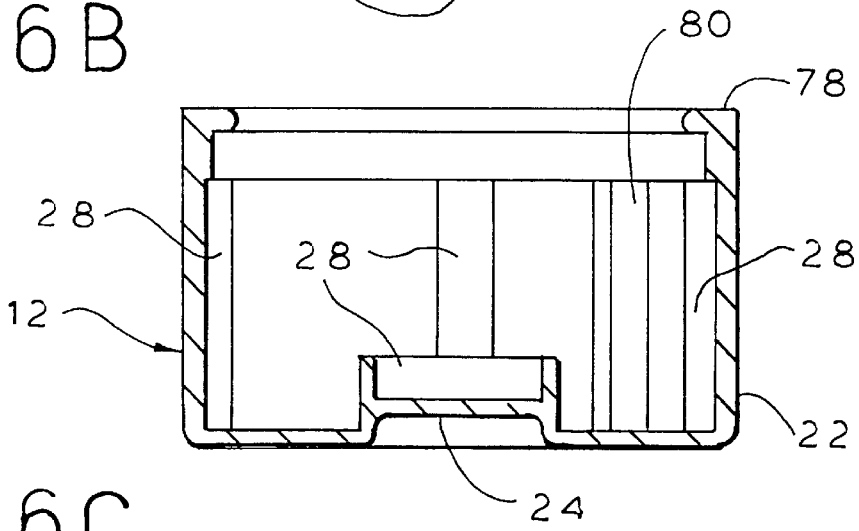
Figure 6C:
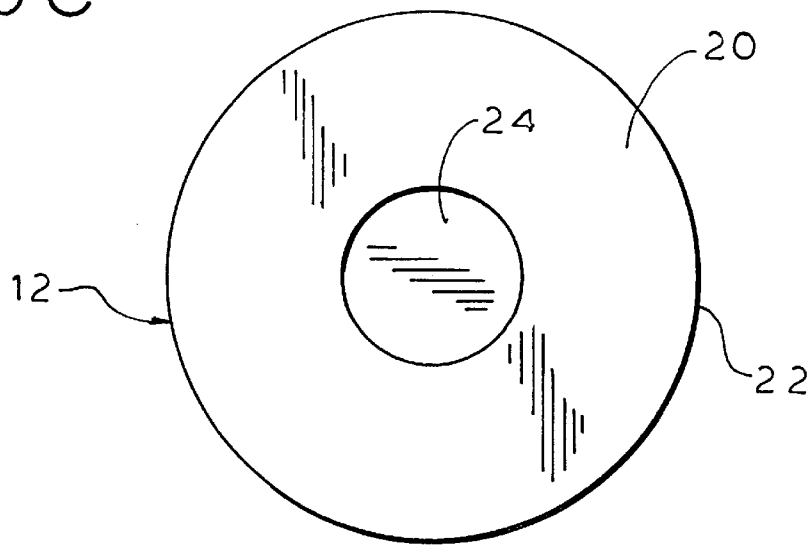
Figure 7A:
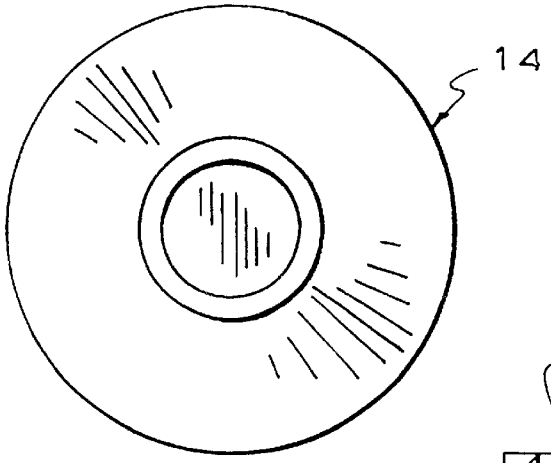
FIGS. 7A, 7B and 7C are top plan, side elevational and bottom plan views, respectively, of the bellows.

Use of the apparatus described above is simple and virtually foolproof. As initially received by a consumer, the base 12 and activator 16 are in a relative rotation such that the actuator flange 42 is within the base flange groove 28 so that the apparatus is in the uncompressed or extended (full) orientation, but with the keys 82 of the actuator 16 being out of vertical alignment with the keyways 80 of the base 12 (see FIG. 1A). Accordingly, the actuator is locked against axial movement in either direction relative to the base. In order to use the apparatus, the base and actuator must be rotated relative to one another until the keys 82 vertically align with the keyways 80 (see FIG. 1B). At this point, movement of the apparatus to its compressed or compact (empty) orientation is made possible. While FIGS. 5A and 6A show a plurality of keys 82 and keyways 80, respectively, theoretically only one key 82 and one keyway 80 will suffice to perform the desired function of disabling or enabling operation of the apparatus. In order to facilitate the user appropriately aligning the key (or keys) 82 and the keyway (or keyways) 80, the base 12 and the actuator 16 preferably bear on their visible outer surface visible indicia indicating the relative rotational orientation thereof. Thus, alignment of the vertical mark 86 on the base 12 with the vertical mark 88 on the actuator 16 would be required before actuation (i.e., axial compression) of the apparatus would be enabled.

Referring now to FIGS. 8A–8D, therein illustrated is a liquid dispenser according to a second or multi-dosage embodiment 10C of the present invention, the apparatus being adapted to provide a plurality (as shown, two) unit dosages from a single dispenser 10C. Instead of a single bellows 14, there are a plurality of bellows 14A, 14B, 14C, 14D (four being illustrated) including a top bellows 14A whose upper surface serves the function of the upper surface of the single bellows embodiment 10A and a bottom bellows 14D whose bottom surface serves the function of the bottom surface of the bellows of the single bellows embodiment 10A. In many ways, the plurality of bellows 14A–D acts as a single bellows. It will be appreciated that the actuator 16 of dispenser 10A illustrated in FIGS. 8A–8D is designed to dispense liquid rather than a spray and hence does not incorporate the spray mechanism 49 shown at the upper end 48 of the actuator of the hollow central post 44 of the actuator 16 of the first embodiment 10 illustrated in FIGS. 1–7.

More particularly, the bellows 14 of the embodiment 10 is replaced in the second embodiment 10A by a plurality of integrally joined bellows 14A–14D in fluid communication with one another and at least some of the bellows being at least partially disposed in the base 12A. The actuator 16 is capable of sequentially assuming multiple orientations relative to the base 12A, thereby to sequentially dispense multiple doses of liquid from the bellows 14A–D. The multiple orientations reflect multiple differing levels of telescoping between the base 12A and the actuator 16.

Figure 8A:
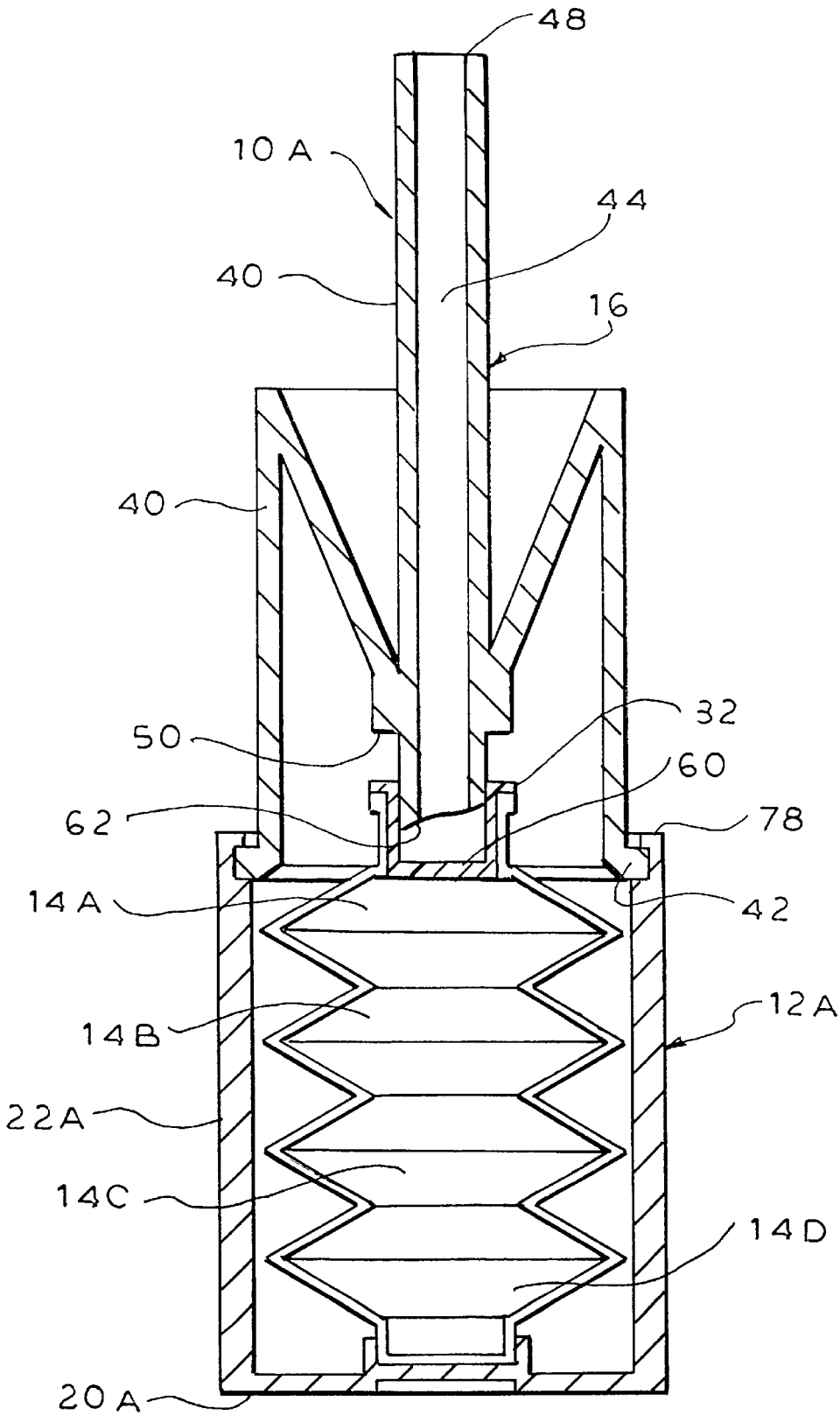
FIGS. 8A, 8B, 8C and 8D are sectional views of a dispenser prior to use, during rupture of the seal, after dispensing of a first unit dosage, and after dispensing of a second unit dosage, respectively.
Figure 8B:
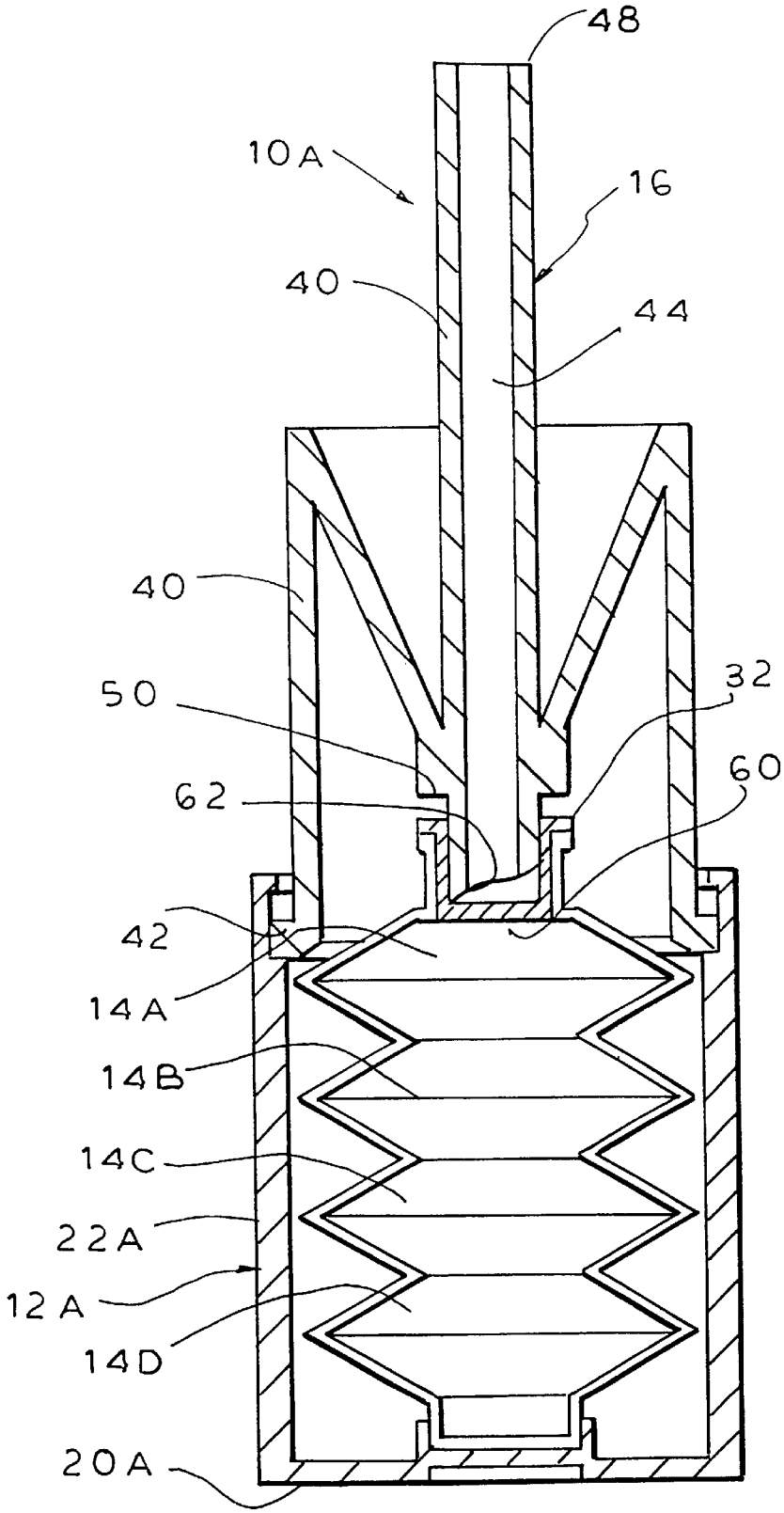
Figure 8C:
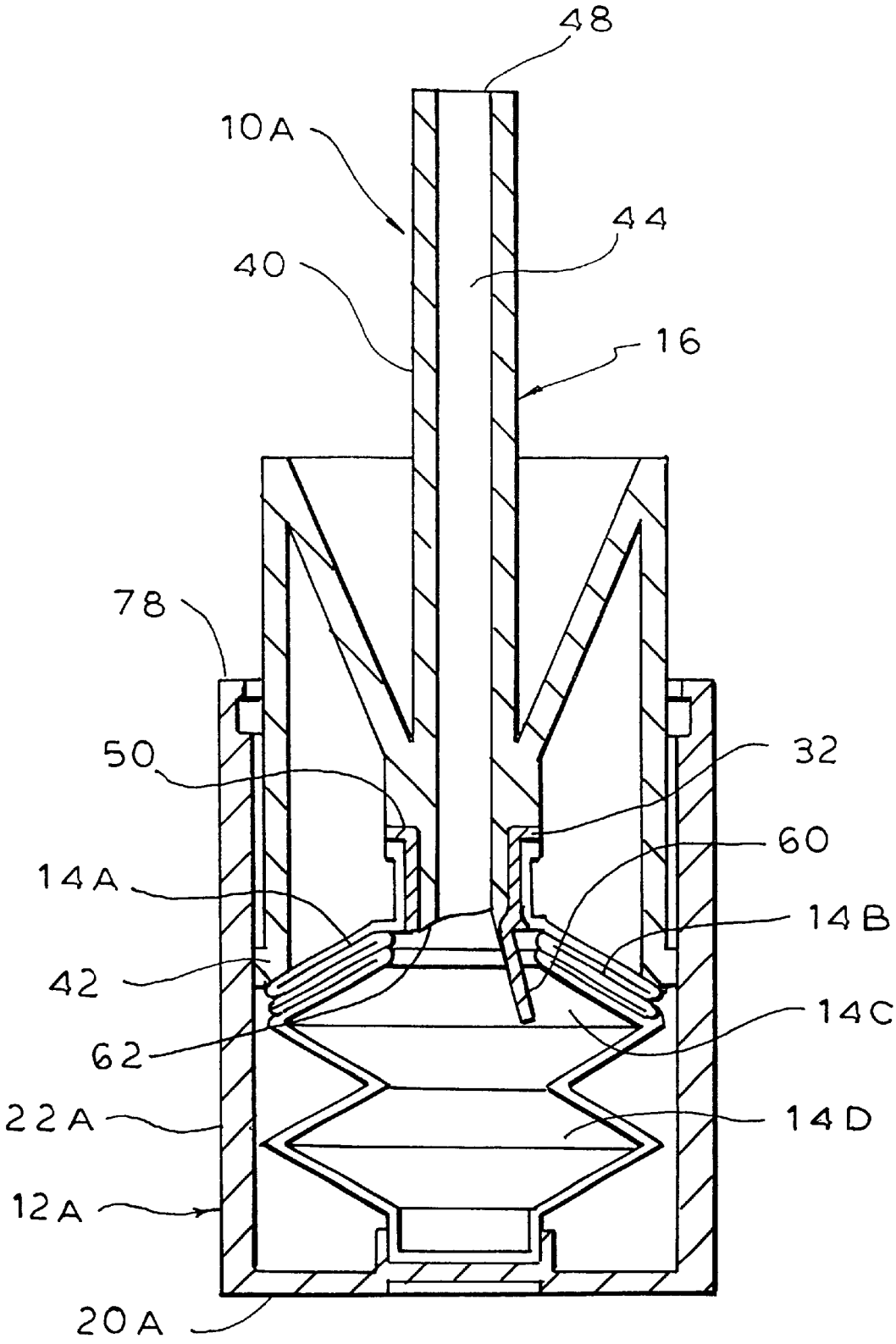
Figure 8D:
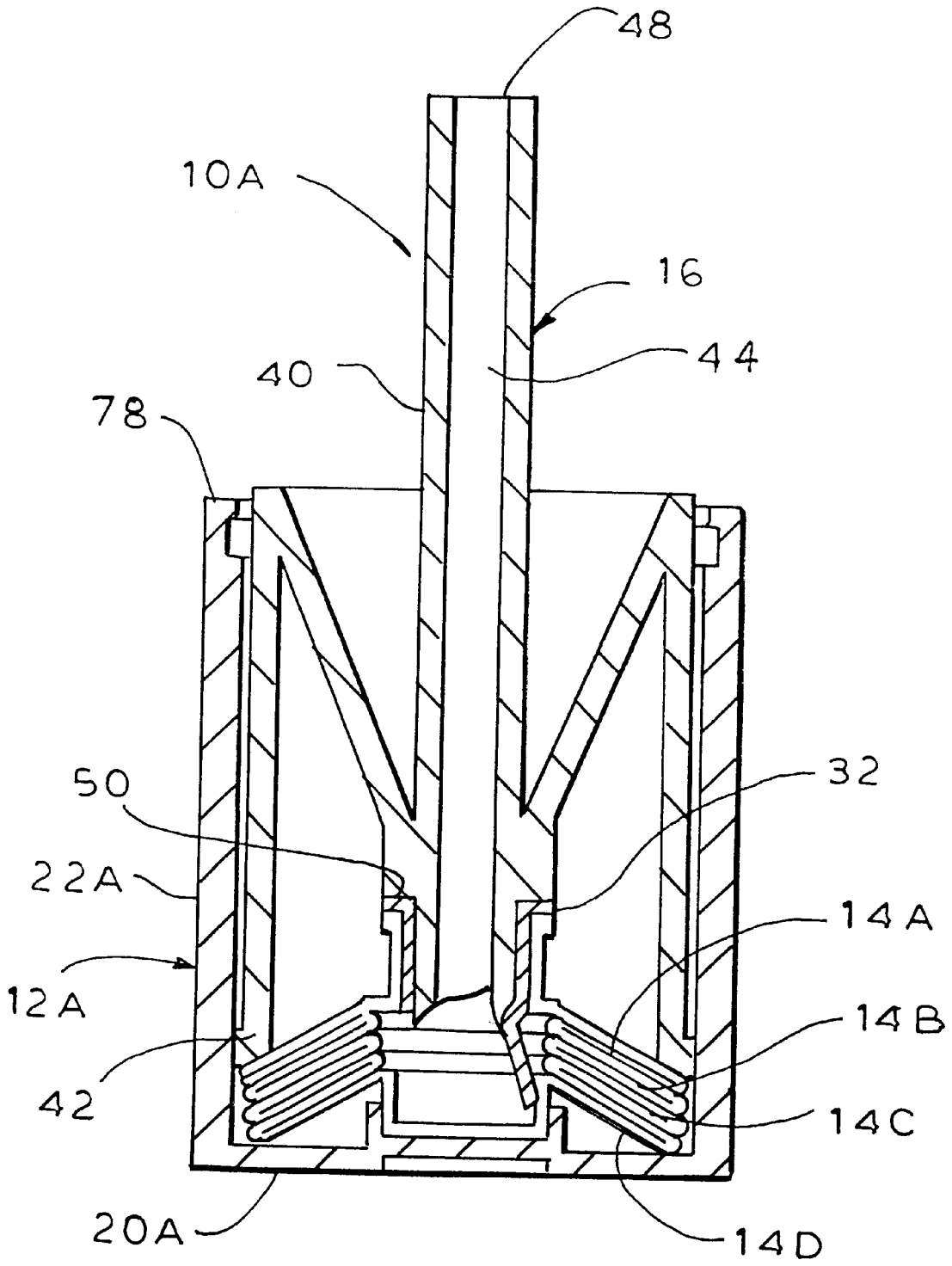

FIG. 8A shows the dispenser in its pre-use orientation, with all four bellows 14A–14D extended. FIG. 8B shows the dispenser after a slight compression which causes slicing of the seal 60. FIG. 8C shows the dispenser after a single unit dosage has been dispensed. FIG. 8D shows the dispenser after both unit dosages have been dispensed—i.e., in its post-use orientation. As illustrated, a unit dosage is the amount of fluid within two of the bellows, so that the four bellows together contain two unit doses. However, clearly each bellows may contain instead a full unit dosage so that there are four unit dosages in the dispenser, and other variations are possible as well.

It will be appreciated that the schematic illustration of FIG. 8C, which shows the top two bellows 14A, 14B becoming compressed and the bottom two bellows 14C, 14D remaining fully extended, does not necessarily correspond to the action of the bellows as a practical matter. For example, all four bellows may be 50% compressed with substantially the same effect. However, analysis of two unit dosage embodiments after dispensing of one unit dosage shown that the top bellows 14A or 14A and 14B have always been in the collapsed orientation while the bottom bellows 14D or 14C and 14D have remained in the extended (full) orientation. Operation of the multi-unit dosage apparatus 10A in this manner provides a more reproducible unit dosage being dispensed from the system, whether it be the first unit dosage or the second unit dosage. However, it will be understood that the present invention is not limited to this sequence of collapse of the bellows. It is theorized that the collapse of the bellows in order—from the top bellows to the bottom bellows—results from the liquid communication between the top bellows and the ambient atmosphere directly, whereas the bottom bellows must pass its liquid through all of the other bellows before the liquid reaches ambient atmosphere.

Figure 9:
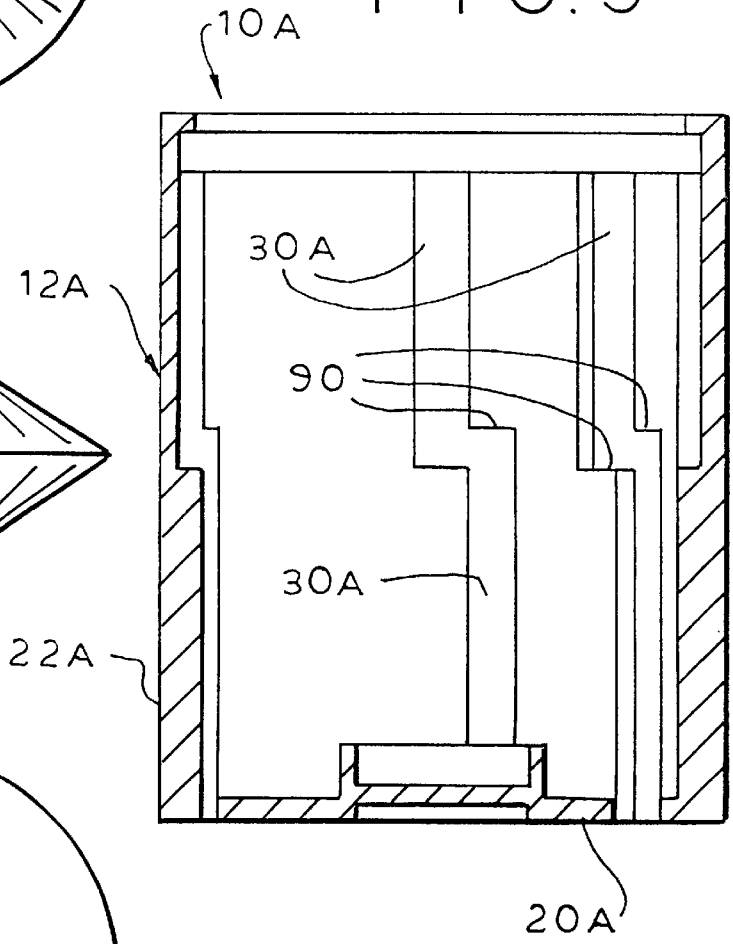
FIG. 9 is a sectional view of the base showing the keyway design for a two-unit dosage embodiment of the apparatus.
Figure 7B:
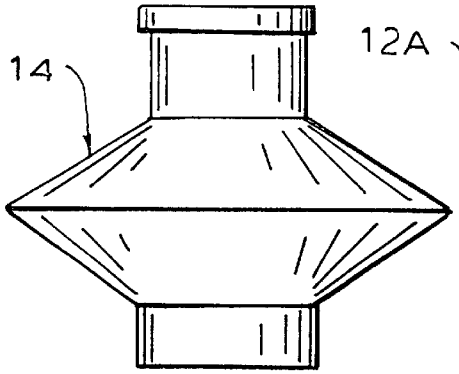
Figure 7C:
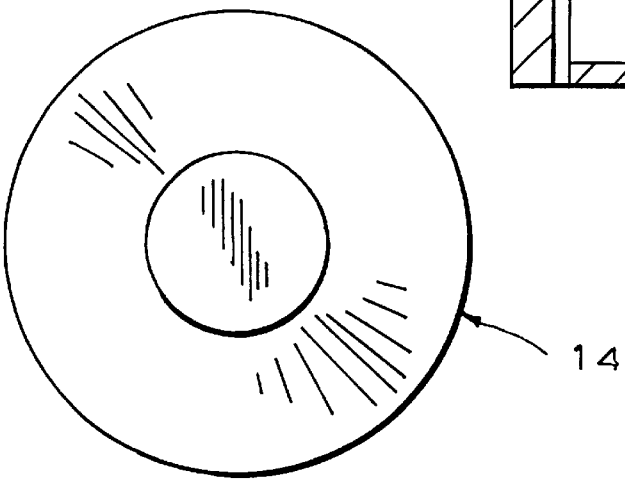

In order to enable the dispensing of a single unit dosage at a time from a dispenser 10A containing a plurality of unit dosages, the earlier described key/keyway system may be used. Referring now to FIG. 9, therein illustrated is a base 12A suitable for use in a multi-unit dispenser 10A in order to achieve successive dispensing of single unit dosages. The actuator of the apparatus 10A is essentially unchanged. The base 12A is similar to the base 12 described hereinabove, except that the keyways 80A extend only half way down the base sidewall 22A and then define a transverse shoulder 90 prior to continuing vertically downwards to the base bottom 20A as keyways 80B. In this example, initial axial compression of the base 12A and actuator 16 enables collapse of only half of the internal volume of the bellows (illustrated in FIG. 8C as collapse of the top two bellows 14A, 14) with axial depression of the base and actuator being stopped by the abutment of an actuator key 82 with the shoulder 90 of the upper keyway 80A (or shoulders 90 of the upper keyways 80A). At this point, the base 12 and actuator 16A must be rotated relative to one another until the actuator key (or keys) 82 is vertically aligned with the lower keyway (or keyways) 80B. Where more than two unit doses are to be discharged, there should be at least two vertically spaced levels of the base keyways defining a shoulder (or shoulders) 90. It is useful to compare FIG. 9 with FIG. 6D to note the differences in the key/keyway designs.

Preferably the visible outer surfaces of the base 12A and the actuator bear visible indicia indicating the relative rotational orientation thereof so that it is easy to move from one relative rotational orientation to another relative rotational orientation. Additionally, at least one of the sets of indicia may be numbered or otherwise characterized so that it can be ascertained at a glance whether the dispenser is full, empty, or somewhere inbetween.

It will be appreciated that, in all of the instances described above, relative rotation of the base and the actuator does not in and of itself cause axial compression of a bellows or the discharge of liquid from the dispenser. The relative rotation merely enables the progressive axial compression of the dispenser so as to sequentially dispense multiple dosages.

While the first embodiment 10 is described in terms of an initial or pre-use orientation which precluded axial compression of the dispenser (due to the presence of flanges 42 in the grooves 28), it will be obvious to those skilled in the art that, especially where relative rotation will subsequently be required for the dispensing of multiple dosages (as in embodiment 10A), that a key/keyway combination may be employed to maintain the dispenser in a pre-use state until relative rotation of the base and actuator vertically aligns the keys 82 and the tops of the keyways 80. Further, in such a multi-dosage dispenser (as in embodiment 10A) the key/keyway combination inherently precludes separation of the base and actuator after use so that the bottom groove 28A is unnecessary and therefore not shown.

To summarize, the present invention provides apparatus for dispensing a preselected amount of liquid where the liquid is stored in at least one bellows, the preselected amount being generally reproducible. The apparatus is simple and economical to manufacture, use and maintain.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, not by the foregoing disclosure.

I claim:

1. Apparatus for dispensing a preselected amount of liquid comprising:

(A) a base;

(B) at least one bellows at least partially disposed in said base and configured and dimensioned to hold a first preselected amount of liquid; and (C) a manually actuable actuator in telescopic relationship with said base for compressing said bellows therebetween and directly and forcibly discharging a second preselected amount of liquid from said bellows to the exterior of said apparatus without regard to internal air pressure within said apparatus.

2. The apparatus of claim 1 wherein said bellows is initially provided with a seal to preclude release of liquid therefrom, and said actuator includes means for rupturing said seal to enable liquid discharge from said bellows.

3. The apparatus of claim 2 wherein, after rupture of said seal, all portions of said seal remain secured to said bellows.

4. The apparatus of claim 2 wherein said rupturing means effects a piercing action on said seal.

5. The apparatus of claim 2 wherein said actuator defines a cup-shaped portion configured and dimensioned to receive and maintain liquid dispensed from said bellows.

6. The apparatus of claim 5 wherein said actuator defines a hollow center post portion having one end in fluid communication with said bellows after rupture of said seal and an opposite end projecting upwardly from said cup-shaped portion.

7. The apparatus of claim 1 wherein said at least one bellows is a plurality of integrally joined bellows in fluid communication with one another and at least partially disposed in said base.

8. The apparatus of claim 7 wherein said actuator is capable of sequentially assuming multiple orientations relative to said base, thereby to sequentially dispense multiple doses of liquid from said bellows.

9. The apparatus of claim 8 wherein the multiple orientations are multiple differing telescopic orientations.

10. The apparatus of claim 1 wherein said base and said actuator bear visible indicia indicating the relative rotational orientation of said base and said actuator.

11. The apparatus of claim 1 wherein said base is in non-rotational sliding telescopic engagement with said actuator due to an internal key and keyway assembly such that axial movement of said actuator relative to said base in a given direction effects at least partial collapse of said bellows.

12. The apparatus of claim 11 wherein said base and said actuator bear visible indicia indicating the relative orientation of said key and keyway.

13. The apparatus of claim 1 wherein said actuator defines a cup-shaped portion configured and dimensioned to receive and maintain liquid dispensed from said bellows.

14. The apparatus of claim 1 wherein said first and second preselected amounts of liquid are substantially the same.

15. The apparatus of claim 1 wherein said first and second preselected amounts of liquid are appreciably different.

16. The apparatus of claim 1 wherein said bellows is disposed intermediate a lower-facing surface of said actuator and an upper-facing surface of said base.

17. The apparatus of claim 1 wherein said actuator directly and forcibly discharges substantially said second preselected amount of liquid from said bellows to the exterior of said apparatus without regard to internal air pressure within said apparatus;

said base being in non-rotational sliding telescopic engagement with said actuator due to an internal key and keyway assembly such that axial movement of said actuator relative to said base in a given direction effects at least partial collapse of said bellows.

18. The apparatus of claim 1 wherein said at least one bellows is a plurality of integrally joined bellows in fluid communication with one another and at least partially disposed in said base; and said actuator is capable of sequentially assuming multiple differing telescopic orientations relative to said base for collapsing an integral number of said integrally joined bellows, thereby to sequentially dispense therefrom multiple unit doses of liquid.

19. Apparatus for dispensing a preselected amount of liquid comprising:

(A) a base;

(B) at least one bellows disposed intermediate said base and an actuator and configured and dimensioned to hold a first preselected amount of liquid greater than a second preselected amount of liquid said bellows being initially provided with a seal to preclude release of liquid therefrom; and (C) a manually actuable actuator in telescopic relationship with said base for compressing said bellows therebetween and discharging the second preselected amount of liquid from said bellows, said actuator including means for rupturing said seal to enable liquid discharge from said bellows after rupture of said seal.

20. The apparatus of claim 19 wherein said actuator defines a cup-shaped portion configured and dimensioned to receive and maintain liquid dispensed from said bellows and a hollow center post portion having one end in fluid communication with said bellows after rupture of said seal and an opposite end projecting upwardly from said cup-shaped portion.

21. The apparatus of claim 19 wherein said at least one bellows is a plurality of integrally joined bellows in fluid communication with one another and at least partially disposed in said base, and said actuator is capable of sequentially assuming multiple orientations relative to said base reflecting differing degrees of telescopic action therebetween, thereby to dispense sequential multiple doses of liquid from said bellows.

22. The apparatus of claim 19 wherein said base is in non-rotational siding telescopic engagement with said actuator due to an internal key and keyway assembly such that axial movement of said actuator relative to said base in a given direction effects at least partial collapse of said bellows, said base and said actuator bearing visible indicia indicating the relative orientation of said key and keyway.

23. Apparatus for dispensing a preselected amount of liquid comprising:

(A) a base;

(B) at least one bellows at least partially disposed in said base and configured and dimensioned to hold a first preselected amount of liquid; and (C) a manually actuable actuator in telescopic relationship with said base for compressing said bellows therebetween and discharging a second preselected amount of liquid from said bellows;

said bellows being initially provided with a seal to preclude release of liquid therefrom, and said actuator including means for rupturing said seal to enable liquid discharge from said bellows.

24. Apparatus for dispensing a preselected amount of liquid comprising:

(A) a base;

(B) at least one bellows at least partially disposed in said base and configured and dimensioned to hold a first preselected amount of liquid; and (C) a manually actuable actuator in telescopic relationship with said base for compressing said bellows therebetween and discharging a second preselected amount of liquid from said bellows;

said base being in non-rotational sliding telescopic engagement with said actuator due to an internal key and keyway assembly such that axial movement of said actuator relative to said base in a given direction effects at least partial collapse of said bellows.

* * * * *